US005674615A

United States Patent [19]

Neuert et al.

[11] Patent Number: 5,674,615

[45] Date of Patent: Oct. 7, 1997

[54] SPIN FINISHED ARAMID FIBERS AND USE THEREOF

[75] Inventors: Richard Neuert, Winkelhaid; Gerhard Stein, Kelheim, both of Germany

[73] Assignee: Hoechst Aktiengesellschaft, Germany

[21] Appl. No.: 410,041

[22] Filed: Mar. 24, 1995

[30] Foreign Application Priority Data

Mar. 28, 1994 [DE] Germany ..... 44 10 708.0

[51] Int. Cl.[6] ..... B32B 27/34

[52] U.S. Cl. ..... 428/395; 428/375; 428/364; 428/378; 8/115.6; 252/8.81; 252/8.84

[58] Field of Search ..... 428/375, 378, 428/395, 364; 8/115.64, 115.56, 115.54; 252/8.6, 8.9, 8.81, 8.84; 524/238

[56] References Cited

U.S. PATENT DOCUMENTS

| | | | |
|---|---|---|---|
| 3,962,516 | 6/1976 | Marshall et al. | 428/394 |
| 4,054,634 | 10/1977 | Marshall et al. | 428/395 |
| 4,108,781 | 8/1978 | Marshall et al. | 428/394 |
| 4,126,564 | 11/1978 | Marshall et al. | 428/395 |
| 4,127,490 | 11/1978 | Newkirk et al. | 428/395 |
| 4,129,507 | 12/1978 | Marshall et al. | 428/395 |
| 4,191,656 | 3/1980 | Marshall | 252/8.6 |
| 4,283,292 | 8/1981 | Marshall et al. | 252/8.8 |
| 4,294,883 | 10/1981 | Hawkins | 428/395 |
| 4,348,517 | 9/1982 | Chakravarti | 428/395 |
| 4,376,802 | 3/1983 | Marshall | 428/395 |
| 4,416,787 | 11/1983 | Marshall et al. | 252/8.8 |
| 4,670,343 | 6/1987 | Makino et al. | 428/395 |
| 4,729,923 | 3/1988 | Windley | 428/395 |
| 4,995,884 | 2/1991 | Ross et al. | 8/115.6 |
| 5,011,616 | 4/1991 | Marshall et al. | 252/8.7 |
| 5,135,811 | 8/1992 | White et al. | 428/395 |
| 5,232,742 | 8/1993 | Chakravarti | 428/395 |
| 5,266,221 | 11/1993 | Kleber et al. | 252/8.9 |
| 5,270,113 | 12/1993 | Rebouillat | 428/375 |
| 5,478,648 | 12/1995 | Stein et al. | 428/375 |

*Primary Examiner*—Jill Gray
*Attorney, Agent, or Firm*—Connolly & Hutz

[57] ABSTRACT

Described are aramid fibers with a spin finish comprising

A) a compound of the formula I and/or II $$R^1—COO—(R^2—O)_x—R^3 \quad (I)$$

$$R^3—(O—R^2)_x—OOC—R^4—COO—(R^2—O)_x—R^3 \quad (II)$$

and B) a compound of the formula III $$R^5—\overset{\overset{R^6}{|}}{\underset{\underset{R^7}{|}}{N^+}}—R^8—COO^-, \quad (III)$$

where $R^1$ is alkyl or alkenyl having eight to eighteen carbon atoms, x is an integer from four to twenty, $R^2$ is butylene, propylene or ethylene, $R^3$ is hydrogen or $C_1$–$C_{22}$-alkyl or $C_2$–$C_{22}$-alkenyl, $R^4$ is alkylene or alkenylene having eight to eighteen carbon atoms, $R^5$ is alkyl or alkenyl having eight to eighteen carbon atoms, $R^6$ and $R^7$ are each alkyl having one to twelve carbon atoms, and $R^8$ is alkylene having one to four carbon atoms. The aramid fibers are usable in particular in the production of textile sheet materials by intermingling, twisting, braiding or folding.

22 Claims, No Drawings

SPIN FINISHED ARAMID FIBERS AND USE THEREOF

FIELD OF THE INVENTION

The present invention relates to aramid fibers which have been coated with a selected spin finish and to the use of these fibers.

DESCRIPTION OF THE PRIOR ART

Aromatic polyamides—also known as aramids—are known fiber-forming materials of high chemical resistance. Aramid fibers are notable in particular for good mechanical properties, such as high strength and moduli.

Aramid fibers, like other fibers too, are customarily spin finished in order that the processing properties in the after-treatment or further processing may be improved. Examples of spin finish systems for aramid fibers may be found in WO-A-92-15,747, EP-A-416,486, EP-A-423,703, JP-A-49-62,722, JP-A-51-88,798 and JP-A-58-46,179 and also Research Disclosures 219,001 and 195,028.

SUMMARY OF THE INVENTION

It has now been found that selected spin finishes confer excellent further processing properties on aramid fibers. The fibers treated according to the present invention exhibit good interfilament cohesion and good antistatic properties of the individual filaments. The present invention provides spin finishes of low surface or interfacial tension and minimal self-color. The spin finishes to be used according to the present invention ensure uniform wetting and dispersion on the fiber surface and significantly reduce the filament/metal friction. The spin finish to be used according to the present invention is further notable for a very low steam and temperature volatility.

The spin finish system of the present invention is notable for good biodegradability; for instance, it is possible to produce spin finishes which are more than 80% biodegradable within the meaning of Administrative Provision 38 of the German Washing and Cleaning Agents Act.

The present invention concerns aramid fibers with a spin finish comprising

A) a compound of the formula I and/or II $$R^1—COO—(R^2—O)_x—R^3 \quad (I)$$

$$R^3—(O—R^2)_x—OOC—R^4—COO—(R^2—O)_x—R^3 \quad (II)$$

and

B) a compound of the formula III $$R^5—\overset{\overset{R^6}{|}}{\underset{\underset{R^7}{|}}{N^+}}—R^8—COO^-, \quad (III)$$

where $R^1$ is alkyl or alkenyl having eight to eighteen carbon atoms, preferably twelve to fourteen carbon atoms, x is an integer from four to twenty, preferably five to fifteen, $R^2$ is butylene, propylene or especially ethylene, $R^3$ is hydrogen or $C_1$–$C_{22}$-alkyl or $C_2$–$C_{22}$-alkenyl, $R^4$ is alkylene or alkenylene having eight to eighteen carbon atoms, preferably twelve to fourteen carbon atoms, $R^5$ is alkyl or alkenyl having eight to eighteen carbon atoms, preferably twelve to fourteen carbon atoms, $R^6$ and $R^7$ are each alkyl having one to twelve carbon atoms, preferably one to six carbon atoms, and $R^8$ is alkylene having one to four carbon atoms, preferably methylene.

DETAILED DESCRIPTION

The spin finish to be used according to the present invention is applied to the aramid fibers in the amount adapted to the particular purpose. This amount customarily ranges from 0.2 to 4% by weight, preferably from 0.5 to 2% by weight, based on the amount of fiber.

The proportions of the individual components A) and B) can be chosen within wide limits.

Component A) is customarily used in amounts from 20 to 80% by weight, preferably 30 to 70% by weight.

Component B) is customarily used in amounts from 20 to 80% by weight, preferably 30 to 70% by weight.

These amounts are each based on the total amount of components A) and B).

As well as these components A) and B), the aramid fiber spin finishes of the present invention may include further ingredients customary for spin finishes. Examples are corrosion inhibitors, coloring components, such as pigments, biocides and preservatives.

Component A) of the spin finishes to be used according to the present invention is a specific polyalkylene glycol ether ester.

$R^1$ and $R^5$ can each be any desired alkyl or alkenyl group having eight to eighteen carbon atoms. These groups can be branched radicals but are preferably straight-chain radicals. $R^1$ and $R^5$ are each particularly preferably alkyl.

Examples of possible alkyl groups are octyl, nonyl, decyl, undecyl, dodecyl, tridecyl, tetradecyl, pentadecyl, hexadecyl, heptadecyl and octadecyl.

The alkenyl groups can be any desired alkenyl radicals having eight to eighteen carbon atoms, which can be straight-chain or branched. Examples of alkenyl are octenyl, nonenyl, decenyl, undecenyl, dodecenyl, tridecenyl, tetradecenyl, pentadecenyl, hexadecenyl, heptadecenyl and octadecenyl.

Particular preference is given to $R^1$ and/or $R^5$ as $C_{12}$–$C_{14}$-alkyl.

$R^2$ is a radical of the formula $—C_nH_{2n}—$ where n is an integer from 2 to 4.

Such radicals are derived from polyalkylene oxides. Preference is given to radicals with n=2 which are derived from ethylene oxide. Further preferred radicals $R^2$, in addition to structural repeat units derived from ethylene oxide, partly include structural repeat units derived from propylene oxide.

$R^3$ can be hydrogen or any desired alkyl or alkenyl group.

Examples of possible alkyl groups, in addition to the radicals recited above in connection with the description of $R^1$, are methyl, ethyl, propyl, butyl, pentyl, hexyl, heptyl, nonadecyl, eicosyl and behenyl. Ethylenically unsaturated radicals are also possible.

$R^3$ is preferably methyl and very particularly preferably hydrogen.

$R^4$ is a radical of the formula $—C_mH_{2m}—$ where m is an integer from 8 to 18.

$R^4$ may further have one or more nonconjugated ethylenically unsaturated bonds. A preferred example of radicals of this type is a radical of the formula $—C_mH_{2m-2}—$ where m is as defined above.

$R^6$ and $R^7$ can each be any desired alkyl group having one to twelve carbon atoms. $R^6$ and $R^7$ can also be different within the scope of the definitions given.

Examples of possible alkyl groups are methyl, ethyl, propyl, butyl, pentyl, hexyl, heptyl, octyl, nonyl, decyl, undecyl and dodecyl.

$R^6$ and $R^7$ are each preferably methyl.

$R^8$ is a branched or especially straight-chain alkylene having one to four carbon atoms. Examples thereof are butylene, propylene, ethylene or preferably methylene.

The compounds of the formula III are usually present mixed with alkali metal halides, preferably with alkali metal chlorides, especially with sodium chloride.

Particular preference is given to aramid fibers with a spin finish comprising compounds of the formulae I and III.

An example of a preferred component A is LEOMIN LS (trademark of Hoechst AG for polyalklene glycol ether ester).

An example of a preferred component B GENAGEN LAB (trademark of Hoechst AG for quaternary ammonium carboxylic acid internal salt).

The fiber of the present invention can be made of any desired aramids. These aramids can be essentially composed of meta-aromatic monomers. An example of compounds of this type is poly(meta-phenyleneisophthalamide).

The fiber-forming material preferably comprises aramids composed to a significant proportion of para-aromatic monomers. Some of these aramids are insoluble in organic solvents and are therefore usually spun from sulfuric acid. An example of compounds of this type is poly(para-phenyleneterephthalamide).

A further preferred group of this type is soluble in organic solvents, especially in polar aprotic solvents.

A soluble aromatic polyamide for the purposes of this invention is any aromatic polyamide which has a solubility in N-methylpyrrolidone of at least 50 g/l at 25° C.

The polar aprotic organic solvent preferably comprises at least one solvent of the amide type, for example N-methyl-2-pyrrolidone, N,N-dimethylacetamide, tetramethylurea, N-methyl-2-piperidone, N,N'-dimethylethyleneurea, N,N,N',N'-tetramethylmaleamide, N-methylcaprolactam, N-acetylpyrrolidine, N,N-diethylacetamide, N-ethyl-2-pyrrolidone, N,N'-dimethylpropionamide, N,N-dimethylisobutylamide, N-methylformamide, N,N'-dimethylpropyleneurea. The preferred organic solvents for the process of the present invention are N-methyl-2-pyrrolidone, N,N-dimethylacetamide and a mixture thereof.

Preference is given to using aromatic polyamides which form isotropic solutions in polar aprotic organic solvents and which contain at least two, in particular three, different structural repeat units which differ in the diamine units.

Preferably the aramid is a polymer with the structural repeat units of the formulae IV, V and optionally VI $$—OC—Ar^1—CO—NH—Ar^2—NH— \quad (IV),$$

$$—OC—Ar^1—CO—NH—Ar^3—NH— \quad (V),$$

$$—OC—Ar^1—CO—NH—Ar^4—NH \quad (VI),$$

where $Ar^1$, $Ar^2$, $Ar^3$ and $Ar^4$ are each independently of the others a bivalent monocyclic or polycyclic aromatic radical whose free valences are disposed para or meta or comparably parallel, coaxial or angled to each other, and $Ar^2$, $Ar^3$ and, if present, $Ar^4$ each have different individual meanings within the scope of the given definitions, and the respective monomer components underlying the polymer are selected so as to produce an aromatic polyamide which forms isotropic solutions in organic solvents.

Any bivalent aromatic radicals whose valence bonds are disposed para or comparably coaxial or parallel to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be bonded linearly to one another via C—C bonds or via —CO—NH— groups.

The valence bonds in mutually coaxial or parallel disposition point in opposite directions. An example of coaxial bonds pointing in opposite directions are the biphenyl-4,4'-ylene bonds. An example of parallel bonds pointing in opposite directions are the naphthylene-1,5 or -2,6 bonds, whereas the naphthylene-1,8 bonds are parallel but point in the same direction.

Examples of preferred bivalent aromatic radicals whose valence bonds are disposed para or comparably coaxial or parallel to each other are monocyclic aromatic radicals having free valences disposed para to each other, especially 1,4-phenylene, or bicyclic fused aromatic radicals having parallel bonds pointing in opposite directions, especially 1,4-, 1,5- and 2,6-naphthylene, or bicyclic aromatic radicals linked by a C—C bond and having coaxial bonds pointing in opposite directions, especially 4,4'-biphenylylene.

Any bivalent aromatic radicals whose valence bonds are disposed meta or comparably angled to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be bonded to one another via C—C bonds or via bridging groups such as —O—, $—CH_2—$, —S—, —CO— or $—SO_2—$.

Examples of preferred bivalent aromatic radicals whose valence bonds are disposed meta or comparably angled to each other are monocyclic aromatic radicals having free valences disposed meta to each other, especially 1,3-phenylene, or bicyclic fused aromatic radicals having mutually angled bonds, especially 1,6- and 2,7-naphthylene, or bicyclic aromatic radicals linked via a C—C bond but having mutually angled bonds, especially 3,4'-biphenylylene.

Minor portions, for example up to 5 mol %, of the monomer units, based on the polymer, can be aliphatic or cycloaliphatic in nature, for example alkylene or cycloalkylene units.

Alkylene is to be understood as meaning branched and especially straight-chain alkylene, for example alkylene having two to four carbon atoms, especially ethylene.

Cycloalkylene radicals are for example radicals having five to eight carbon atoms, especially cycloalkylene.

All these aliphatic, cycloaliphatic or aromatic radicals can be substituted by inert groups. These are substituents which have no adverse effect on the contemplated application.

Examples of such substituents are alkyl, alkoxy or halogen.

Alkyl is to be understood as meaning branched and especially straight-chain alkyl, for example alkyl having one to six carbon atoms, especially methyl.

Alkoxy is to be understood as meaning branched and especially straight-chain alkoxy, for example alkoxy having one to six carbon atoms, especially methoxy.

Halogen is for example fluorine, bromine or in particular chlorine.

Preference is given to aromatic polyamides based on unsubstituted radicals.

The dicarboxylic acid unit in the aromatic polyamides comprising the structural repeat units of the formulae IV, V and optionally VI is preferably terephthalic acid.

Examples of preferred diamine combinations from which these preferred structural repeat units of the formulae IV, V and VI are derived are 1,4-phenylenediamine, 4,4'-diaminodiphenylmethane and 3,3'-dichloro-, 3,3'-dimethyl- or 3,3'-dimethoxybenzidine; also 1,4-phenylenediamine, 1,4-bis(aminophenoxy)benzene and 3,3'-dichloro-, 3,3'-dimethyl- or 3,3'-dimethoxybenzidine; and also 1,4-phenylenediamine, 3,4'-diaminodiphenyl ether and 3,3'-dichloro-, 3,3'-dimethyl- or 3,3'-dimethoxybenzidine; and also 1,4-phenylenediamine, 3,4'-diaminodiphenyl ether and 4,4'-diaminobenzanilide; and also 1,4-phenylenediamine, 1,4-bis(aminophenoxy)benzene and 3,4'-diaminodiphenyl ether.

Aramids which are derived from such diamine combinations and which are preferably for use according to the present invention are described in EP-A-199,090, EP-A-364,891, EP-A-364,892, EP-A-364,893 and EP-A-424,860.

The aromatic polyamides to be used according to the present invention are known per se and can be prepared by methods known per se.

Of these preferred aramids, particular preference is given particularly to those where $Ar^1$ is a bivalent monocyclic or polycyclic aromatic radical whose free valences are disposed para or comparably parallel or coaxial to each other, $Ar^2$ is a bivalent monocyclic or polycyclic aromatic radical whose free valences are disposed para or comparably parallel or coaxial to each other, $Ar^3$ is a radical of the formula VII $$—Ar^5—X—Ar^6— \quad \text{(VII)},$$

where $Ar^5$ and $Ar^6$ are independently of each other a bivalent monocyclic or polycyclic aromatic radical whose free valences are disposed para or comparably parallel or coaxial to each other or where $Ar^6$ additionally is a bivalent monocyclic or polycyclic aromatic radical whose free valences are disposed meta or comparably angled to each other, X is a group of the formula —O—, —S—, —$SO_2$—, —O-phenylene-O— or alkylene, and where $Ar^4$ has one of the meanings defined for $Ar^2$ or $Ar^3$ but differs from the particular $Ar^2$ or $Ar^3$ of a molecule.

Very particular preference is given to aramids where $Ar^1$ is 1,4-phenylene, $Ar^2$ is 1,4-phenylene or a bivalent radical of 4,4'-diaminobenzanilide, $Ar^5$ and $Ar^6$ are each 1,4-phenylene, X is —O—, -$CH_2$— or —O-1,4-phenylene-O—, and $Ar^4$ is a bivalent radical of 3,4'-diaminodiphenyl ether, of 3,3'-dichlorobenzidine, of 3,3'-dimethylbenzidine or of 3,3'-dimethoxybenzidine.

The term "fiber" is to be understood in the context of this invention in its widest sense; fiber as used herein thus includes for example endless, continuous filament fibers, such as mono- or multifilaments, or staple fibers, or pulp. The spin finish to be used according to the present invention is preferably used on aramid filaments.

The production of the aramid fibers to be used according to the present invention can be effected by processes known per se, as described for example in EP-A-199,090, EP-A-364,891, EP-A-364,892, EP-A-364,893 and EP-A-424,860.

The spin finish can be applied directly after the spinning of the filaments or in the aftertreatment. The spin finishes to be used according to the present invention are applied in particular in the form of aqueous emulsions.

Application can be by means of known apparatus, such as dipping, roller lick or spraying.

The aramid fibers treated according to the present invention can have been treated with an organic or inorganic drawing finish.

The aramid fibers of the present invention are notable for excellent mechanical properties, such as high breaking strength and initial moduli and low breaking extensions, and also for the abovementioned favorable application and further processing properties.

The fibers of the present invention preferably have filament linear densities of not less than 0.5 dtex, in particular from 1 to 20 dtex.

The tenacity of the fibers of the present invention is preferably from 40 to 290 cN/tex.

The initial modulus, based on 100% extension, of the fibers of the present invention is preferably from 10 to 130 N/tex.

The cross section of the individual filaments of the fibers of the present invention can be optional, for example triangular, tri- or multilobal or in particular elliptical or round.

The fibers of the present invention, which have excellent mechanical and thermal properties and are notable for high drawability, can be further processed and used in industry in a wide variety of ways.

The aramid fibers of the present invention, possessing good interfilament cohesion and excellent antistatic properties, are used in particular in the production of textile sheet materials by intermingling, twisting, braiding or folding. The aramid fibers of the present invention are preferably used in knitting or weaving. The invention also provides for the use for these purposes.

The aramid fibers of the present invention are processible in particular into woven fabrics, knitted fabrics, laid fabrics, braids or webs.

As mentioned earlier, the spin finished aramid fibers of the present invention are notable for a whole series of advantageous properties.

Trials have shown that the temperature volatility of the spin finishes of the present invention at 200° C. was less than 10%, whereas conventional spin finishes have temperature volatilities of up to about 60%.

Furthermore, the steam volatility of the spin finishes of the present invention at 102° C. is less than 10%, whereas conventional spin finishes have steam volatilities of up to 25%.

Moreover, the filament/metal friction of the spin finishes of the present invention is 15–20% lower than the values obtained with conventional systems.

In addition, it was found that the abrasion of the spin finishes of the present invention, for example in the course of twisting, was very low and the abraded-off material was in the form of a dust, was readily removable and did not form a tacky build-up on the deflecting elements. Compared with conventional systems, an improvement of about 30% was observed.

It was additionally found that the interfilament cohesion, or transverse cohesion between the filaments, of the spin finished aramid fibers of the present invention was about 15–20% higher than that obtained with conventional systems.

What is claimed is:

1. A spin-finished aramid fiber comprising an aramid fiber having a spin finish composition coated thereon, said spin finish composition comprising:

A. a compound of the formula I or II $$R^1—COO—(R^2—O)_x—R^3 \quad (I)$$

$$R^3—(O—R^2)_x—OOC—R^4—COO—(R^2—O)_x—R^3 \quad (II)$$

or a combination thereof, and

B. a compound of the formula III $$R^5—\overset{\overset{R^6}{|}}{\underset{\underset{R^7}{|}}{N^+}}—R^8—COO^-, \quad (III)$$

where $R^1$ is alkyl or alkenyl having eight to eighteen carbon atoms,

X is an integer from four to twenty, $R^2$ is butylene, propylene or ethylene, $R^3$ is hydrogen or alkyl having 1 to 22 carbon atoms or alkenyl having 2 to 22 carbon atoms, $R^4$ is alkylene or alkenylene having eight to eighteen carbon atoms, $R^5$ is alkyl or alkenyl having eight to eighteen carbon atoms, $R^6$ and $R^7$ are each alkyl having one to twelve carbon atoms, and $R^8$ is alkylene having one to four carbon atoms.

2. The spin-finished aramid fiber of claim 1, wherein said spin-finish composition is essentially biodegradable.

3. The spin-finished aramid fiber of claim 2 where the amount of spin finish composition coated onto said spin-finished aramid fiber ranges from 0.5 to 4% by weight, based on the amount of fiber.

4. The spin-finished aramid fiber of claim 2 where the spin finish composition comprises 20 to 80% by weight of component A and 20 to 80% by weight of component B, these percentages being based on the total amount of components A and B.

5. The spin-finished aramid fiber of claim 4 wherein the spin finish composition comprises 30 to 70% by weight of component A and 30 to 70% by weight of component B.

6. The spin-finished aramid fiber of claim 2 where $R^1$ and $R^5$ are each straight-chain alkyl or alkenyl having 12 to 14 carbon atoms; x is a number from 5 to 15; $R^2$ is ethylene; $R^4$ is alkylene or alkenylene having 12 to 14 carbon atoms; $R^6$ and $R^7$ are each alkyl having 1 to 6 carbon atoms; and $R^8$ is methylene.

7. The spin-finished aramid fiber of claim 2 where $R^2$ is a radical of the formula $—C_nH_{2n}—$ where n=2.

8. The spin-finished aramid fiber of claim 2 where $R^3$ is methyl or hydrogen.

9. The spin-finished aramid fiber of claim 2 where $R^3$ is hydrogen.

10. The spin-finished aramid fiber of claim 2 where $R^4$ is a radical of the formula $—C_mH_{2m}—$ where m is an integer from 8 to 18.

11. The spin-finished aramid fiber of claim 2 where $R^6$ and $R^7$ are each methyl.

12. The spin-finished aramid fiber of claim 2 where $R^8$ is methylene.

13. The spin-finished aramid fiber of claim 2 where said compound of the formula III is present in the spin finish composition in admixture with an alkali metal chloride.

14. The spin-finished aramid fiber of claim 2 where the spin finish composition comprises compounds of the formulae I and III.

15. The spin-finished aramid fiber of claim 2 wherein the aramid fiber consists essentially of an aromatic polyamide that is soluble in organic solvents.

16. The spin-finished aramid fiber of claim 15 wherein the aromatic polyamide is a polymer with the structural repeating units of the formulae IV and V $$—OC—Ar^1—CO—NH—Ar^2—NH— \quad (IV),$$

$$—OC—Ar^1—CO—NH—Ar^3—NH— \quad (V),$$

and optionally VI $$—OC—Ar^1—CO—NH—Ar^4—NH— \quad (VI),$$

where $Ar^1$, $Ar^2$, $Ar^3$ and $A^4$, $A^4$ being optionally present, are each independently of the others a bivalent monocyclic or polycyclic aromatic radical whose free valences are disposed para or meta or comparably parallel, coaxial or angled to each other, and $Ar^2$, $Ar^3$ and, if present, $Ar^4$ each have different individual meanings within the scope of the given definitions, and the respective monomer components underlying the polymer are selected so as to produce an aromatic polyamide which forms isotropic solutions in organic solvents.

17. The spin-finished aramid fiber of claim 16 wherein $Ar^1$ is a bivalent monocyclic or polycyclic aromatic radical whose free valences are disposed para or comparably parallel or coaxial to each other, $Ar^2$ is a bivalent monocyclic or polycyclic aromatic radical whose free valences are disposed para or comparably parallel or coaxial to each other, $Ar^3$ is a radical of the formula VII $$—Ar^5—X—Ar^6 \quad (VII),$$

where $Ar^5$ and $Ar^6$ are independently of each other a bivalent monocyclic or polycyclic aromatic radical whose free valences are disposed para or comparably parallel or coaxial to each other or where $Ar^6$ additionally is a bivalent monocyclic or polycyclic aromatic radical whose free valences are disposed meta or comparably angled to each other, X is a group of the formula —O—, —S—, $—SO_2—$, —O—phenylene-O— or alkylene, and where $Ar^4$ has one of the meanings defined for $Ar^2$ or $Ar^3$ but differs from the particular $Ar^2$ or $Ar^3$ of a molecule.

18. The spin-finished aramid fiber of claim 17 wherein $Ar^1$ is 1,4-phenylene, $Ar^2$ is 1,4-phenylene or a bivalent radical of 4,4'-diaminobenzanilide, $Ar^5$ and $Ar^6$ are each 1,4-phenylene, X is —O—, $—CH_2—$ or —O—1,4-phenylene-O—, and $Ar^4$ is a bivalent radical of 3,4'-diaminodiphenyl ether, of 3,3'-dichlorobenzidine, of 3,3'-dimethylbenzidine or of 3,3'-dimethoxybenzidine.

19. The spin-finished aramid fiber of claim 2 in the form of filaments.

20. The spin-finished aramid fiber of claim 1, wherein $R^1$ is alkyl or alkenyl having 12 to 14 carbon atoms, x is an integer from five to fifteen, $R^2$ is ethylene, $R^4$ is alkylene or alkenylene having twelve to fourteen carbon atoms, $R^5$ is alkyl or alkenyl having twelve to fourteen carbon atoms, $R^6$ and $R^7$ are each alkyl having one to six carbon atoms, and $R^8$ is methylene.

21. A spin-finished aramid fiber comprising an aramid fiber having a spin finish composition coated thereon, said spin finish composition consisting essentially of:

A. a compound of the formula I or II $$R^1—COO—(R^2—O)_x—R^3 \quad (I)$$

$$R^3—(O—R^2)_x—OOC—R^4—COO—(R^2—O)_x—R^3 \quad (II)$$

or a combination thereof,

B. a compound of the formula III $$R^5—\overset{\overset{R^6}{|}}{\underset{\underset{R^7}{|}}{N^+}}—R^8—COO^- \quad (III)$$

where $R^1$ is alkyl or alkenyl having eight to eighteen carbon atoms, x is an integer from four to twenty, $R^2$ is butylene, propylene or ethylene, $R^3$ is hydrogen or alkyl having 1 to 22 carbon atoms or alkenyl having 2 to 22 carbon atoms, $R^4$ is alkylene or alkenylene having eight to eighteen carbon atoms, $R^5$ is alkyl or alkenyl having eight to eighteen carbon atoms, $R^6$ and $R^7$ are each alkyl having one to twelve carbon atoms, and $R^8$ is alkylene having one to four carbon atoms.

22. The spin-finished aramid fiber of claim 21, wherein $R^1$ is alkyl or alkenyl having 12 to 14 carbon atoms, x is an integer from five to fifteen, $R^2$ is ethylene, $R^4$ is alkylene or alkenylene having twelve to fourteen carbon atoms, $R^5$ is alkyl or alkenyl having twelve to fourteen carbon atoms, $R^6$ and $R^7$ are each alkyl having one to six carbon atoms, and $R^8$ is methylene, C. optionally, an emulsifying medium, and D. optionally, a corrosion inhibitor, a coloring component, a biocide, a preservative, or a combination thereof.

* * * * *